US010633823B2

(12) United States Patent
Hou et al.

(10) Patent No.: US 10,633,823 B2
(45) Date of Patent: Apr. 28, 2020

(54) METHOD OF IDENTIFYING A DIFFICULTY LEVEL OF AN OPERATING CONDITION OF A LOADER

(71) Applicant: XIAMEN UNIVERSITY, Xiamen (CN)

(72) Inventors: Liang Hou, Xiamen (CN); Shaojie Wang, Xiamen (CN); Xiangjian Bu, Xiamen (CN)

(73) Assignee: XIAMEN UNIVERSITY, Xiamen (CN)

( * ) Notice: Subject to any disclaimer, the term of this patent is extended or adjusted under 35 U.S.C. 154(b) by 0 days.

(21) Appl. No.: 16/067,740

(22) PCT Filed: Jul. 3, 2017

(86) PCT No.: PCT/CN2017/091433
§ 371 (c)(1),
(2) Date: Jul. 2, 2018

(87) PCT Pub. No.: WO2018/014718
PCT Pub. Date: Jan. 25, 2018

(65) Prior Publication Data

US 2019/0024341 A1 Jan. 24, 2019

(30) Foreign Application Priority Data

Jul. 22, 2016 (CN) ..... 2016 1 0585014
Jul. 22, 2016 (CN) ..... 2016 1 0585057

(51) Int. Cl.
*E02F 9/20* (2006.01)
*E02F 3/30* (2006.01)
*E02F 9/22* (2006.01)

(52) U.S. Cl.
CPC ..... *E02F 9/2029* (2013.01); *E02F 3/30* (2013.01); *E02F 9/20* (2013.01); *E02F 9/2004* (2013.01); *E02F 9/2253* (2013.01)

(58) Field of Classification Search
CPC ..... B60W 10/06; B60W 10/30; E02F 9/2029; E02F 9/2253; E02F 9/2004; E02F 9/2246;
(Continued)

(56) References Cited

U.S. PATENT DOCUMENTS 3,643,828 A * 2/1972 Elliott ..... E02F 3/434 414/699
6,202,014 B1 * 3/2001 Brandt ..... E02F 3/3414 172/12
(Continued)

FOREIGN PATENT DOCUMENTS

CN 101806079 A 8/2010
CN 201649154 U 11/2010
(Continued)

OTHER PUBLICATIONS

"Evaluating Wheel Loader Operating Conditions Based on Radar Chart", Aug. 2017; Shaojie W.A.N.G., Liang H.O.U., Jay Lee and Xiangjian B.U.; Automation in Construction, 8 pgs.
(Continued)

*Primary Examiner* — Robert E Pezzuto
(74) *Attorney, Agent, or Firm* — Cooper Legal Group, LLC

(57) ABSTRACT

The identification method of the difficulty level of the operating condition of the loader, takes the excavating operation segments extracted by the operation segment as the main objects of study to identify the operating conditions, and finally get the difficulty level value of the operating condition. The identification of the difficulty level of the operating condition is beneficial to control the power
(Continued)

output mode of diesel engine and realize the distribution according to demand; simultaneously, as the judgement basis of intelligent shift control strategy, it has great significance for intelligent shift, power mode control and improving operation performance of engineering vehicles. It is also beneficial to the improvement of the performance and the energy saving and emission reduction; at the same time, the identification of the difficulty level of the operating condition is used to realize the change of power regulation, improve the application scope of engineering machinery.

10 Claims, 4 Drawing Sheets

(58) Field of Classification Search
CPC ..... E02F 9/2296; E02F 9/226; E02F 9/2267; E02F 9/2271; E02F 9/2426; E02F 3/30; E02F 3/3414; E02F 3/431; E02F 9/20; G06K 9/00; G06K 9/00496; G06K 9/00503; G06K 9/00523; G06Q 50/08
USPC .... 37/347, 348, 414; 60/420, 431, 449, 484; 172/2–12, 263, 812; 701/36, 50, 53
See application file for complete search history.

(56) References Cited

U.S. PATENT DOCUMENTS

| | | | | |
|---|---|---|---|---|
| 6,493,616 | B1 * | 12/2002 | Rossow | E02F 9/205 37/414 |
| 7,543,447 | B2 * | 6/2009 | Itoga | B60W 10/06 60/431 |
| 2010/0065155 | A1 | 3/2010 | Peltomae et al. | |

FOREIGN PATENT DOCUMENTS

| | | | |
|---|---|---|---|
| CN | 102071717 | A | 5/2011 |
| CN | 202187764 | U | 4/2012 |
| CN | 102518163 | A | 6/2012 |
| CN | 102535573 | A | 7/2012 |
| CN | 102877500 | A | 1/2013 |
| CN | 104074225 | A | 10/2014 |
| CN | 106096593 | A | 11/2016 |
| CN | 106296474 | A | 1/2017 |

OTHER PUBLICATIONS

"Load Spectrum Compiling Based on Operation Section Recognition and Fatigue Life Prediction of Wheel Loader Axle shaft", Dec. 2017; Yi-Kai Fang, Liang Hou, Shao-Jie Wang,Ding Chen and Teng-Peng Guo; Science Technology and Engineering, vol. 17, No. 34, Abstract in English on p. 7, 7 pgs.

"Control Method of Lunar Drilling Based on Online Identification of Drilling Ability"; Dec. 2015; Junyue Tang, Qiquan Quan, Shengyuan Jiang. Xuyan Hou and Zongquan Deng; Journal of Deep Space Exploration, vol. 2 No. 4, Abstract in English on p. 8, 8 pgs.

"Research and Application of Intelligent Shift Technology for Engineering Vehicle Based on Working Spectrum Analysis and Pattern Recognition", Jun. 2017, cited on the Internet at: In.wanfangdata.com.cn; Abstract in English on p. 9, 181 pgs.

"Compilation Method of Power Train Load Spectrum of Engineering Vehicle", Apr. 2011; Zhang Yingshuang, Wang Guoqiang, Wang Jixin, Jia Haibo and Zhang Erping; Tranactions of the CSAE, vol. 27, No. 4, Abstract in English on p. 5, 5 pgs.

"Research on the Method of Reasonable Match of Construction Machine in the Multi-Constructing Section"; May 2008; Yongping Wu; Construction Machinery Technology & Management, Fifth phase, English abstract on p. 3, 3 pgs.

"Analysis on Construction Technique of Concrete Pump With High Performance", May 2008; Jianming Li; Construction Machinery Technology & Management, Fifth phase, English abstract on p. 2, 2 pgs.

"Optimizing Design of Excavator Backhoe Working Device and Machine Stability Analysis", 2014, Xiamen University Institutional Repository, Abstract in English on p. 9, 84 pgs.

* cited by examiner

METHOD OF IDENTIFYING A DIFFICULTY LEVEL OF AN OPERATING CONDITION OF A LOADER

TECHNICAL FIELD

The present invention relates to technology of identifying the difficulty level of the operating condition of engineering vehicles, more specifically to a method of identifying the difficulty level of the operating condition of a loader.

BACKGROUND OF THE INVENTION

Engineering vehicles are of construction machinery based on work, most of them use hydraulic transmission in order to obtain large torque and large inertia load demand. Due to bad working environment, complex operating conditions and continuous improvement of automation and informatization, how to ensure a reliable and efficient operation of the construction machinery is a technical problem to be solved at present. Different operating conditions have a great influence on the fuel economy of the vehicle, in particular in excavating high density materials such as primary soil and iron ore, etc. Different operating conditions require different shift control strategy and rate of work mode. Therefore, how to effectively identify the difficulty level of operating conditions is of great significance for improving the working performance and intelligence of construction machinery.

Take a typical prototype loader in construction vehicles as an example, the loader is a multipurpose and efficient construction machinery with large, medium, small model, which is mainly used for loading and unloading soil, gravel, coal and other comprehensive materials. The loader is suitable for the mines, ports, infrastructure, road construction and other operations, so it is widely used in factories, stations, wharves, freight yards, warehouses and so on. The density of ore and solid primary soil is large while the density of loose materials, such as soil and coke, is light. Because of the different operating conditions, the selection of loaders also has a big difference. For those materials with high density, such as solid primary soil and ore, due to the high requirement of traction it should select the lower working speed product with larger digging force and traction to ensure the normal use. Loose material does not require large traction to the loader, so high speed products can be selected for higher efficiency. It can be seen that different working media have different operating conditions. If the operating conditions can not be identified, the construction machinery enterprises can only produce special products for every particular working medium. Take Yutong Heavy Industry as an example, to meet the needs of users in different operating conditions and coal loading operations, Yutong Heavy Industry provides coal mine-specific bucket, coke-specific bucket, rock bucket, catching wood, pushing snow and other different working devices to meet the different types of loaders, so the loader can be a multipurpose machine.

SUMMARY OF THE INVENTION

The present invention, whose purpose is to overcome the deficiencies of the prior art, provides a method to identify the difficulty level of the loader operating condition, which can expand the scope of application of construction machinery, realize multiple functions of one machine, and be capable of applying in many operating conditions with different medias at the same time, and improve the operation performance and intelligence level.

The technical scheme of the present invention is as follows:

A method of identifying the difficulty level of the operating conditions of a loader, wherein the method comprises the steps:

1) Obtaining the signal of the large chamber pressure of the moving arm and the large chamber pressure of the rotating bucket from the loader, then extracting the working cycle from the signal of the large chamber pressure of the moving arm and the large chamber pressure of the rotating bucket;
2) Extracting the excavating operation segments based on the obtained working cycle;
3) Obtaining the excavate time of the large chamber pressure of the moving arm, the change rate of the excavate time, the maximum value of the pressure of the large chamber of the moving arm and the change rate of the maximum value of the pressure of the large chamber of the moving arm in the excavating operation segments, then the difficulty level index of the operating condition is obtained according to the presupposed rules.

In another preferred embodiment, in the excavating operation segments, the minimum point which formed before the pressure of the large chamber of the moving arm contact material is defined as the starting time of the excavation section; the first maximum value point of the pressure of the large chamber of the rotating bucket is defined as the end time of the excavation section;

In another preferred embodiment, in the step 3), the fuzzy logic C-means clustering algorithm is used to cluster analysis of the excavate time, the change rate of the excavate time, the maximum value of the pressure of the large chamber of the moving arm and the change rate of maximum value of the pressure of the large chamber of the moving arm.

In another preferred embodiment, assuming that the sequence of the excavate time length is $T=(t_1, t_2, \ldots, t_i, \ldots, t_{n-1}, t_n)$, according to the fuzzy logic C-means clustering algorithm, the length of the excavate time $t_{FCM}$ and the change rate of the excavate time $u_t$ in each section are obtained:

$$u_t = \frac{|t_i - t_{FCM}|}{t_{FCM}},$$

therein, i=1, 2, . . . , n;

calculating the cluster center value $u_{FCM}$ according to the change rate of the excavate time $u_t$, and $u_{FCM}$ is used as the evaluation value of the change rate of the excavate time.

In another preferred embodiment, assuming that there is only one excavating operation in a excavating time, and make all curves of the pressure of the large chamber of the moving arm in the excavating operation segments are second-order parabolic fitted, the fitting function is: $p=a+bt+ct^2$;

according to the fitting function, the maximum value $p_{max}$ of the pressure of the large chamber of the moving arm and the time t to reach the maximum value are obtained, then the formula of the maximum value change rate of the pressure of the large chamber of the moving arm is as follows:

$$u_p = \frac{|p_i - p_{max}|}{p_{max}},$$

wherein, i=1, 2, . . . , n;

therein, $u_p$ is the maximum value change rate of the pressure of the large chamber of the moving arm, $p_i$ is one value of the pressure of the large chamber of the moving arm, $p_{max}$ is the maximum value of the pressure of the large chamber of the moving arm.

In another preferred embodiment, the excavate time, the change rate of the excavate time, the maximum value of the pressure of the large chamber of the moving arm and the change rate of maximum value of the pressure of the large chamber of the moving arm are mapped to the radar chart of the unit circle, and the values are treated with positive normalization.

In another preferred embodiment, after the positive normalization value is obtained, it is and expressed by radar chart; by calculating the cover area of each operating condition in the radar chart. The ad defining ratio of each radar chart to the unit circle area is defined as the work difficulty value, and getting the index of the difficulty level of the operating condition.

In another preferred embodiment, the work cycle comprises a digging work section, a heavy haul transportation work section and an unloading work section.

In another preferred embodiment, the extraction of the work cycle comprises the following steps:

(1) acquisition pressure signal:

Obtaining the signal of the pressure of the large chamber of the moving arm and the rotating bucket large chamber from the loader;

(2) extracting work cycle:

cleaning and calculating the signal of the pressure of the large chamber of the moving arm to obtain the minimum value point B; the starting point A1 and the ending point A4 of the working section are obtained according to the minimum point B.

cleaning and calculating the signal of the pressure of the large chamber of the rotating bucket to obtain the maximum value point C. Based on the maximum point C, the nodes A2 and A3 of the working section are obtained;

(3) extract valid works:

obtain A1, A2, A3, A4 by above mentioned calculation and obtain effective work information, therein, the excavating operation segment is between A1 and A2.

The beneficial effects of the present invention are as follows:

The method of identifying the difficulty level of the operating conditions of a loader described in the present invention takes the excavating operation segments extracted by the operation segments as the main objects of study to identify the operating conditions, and finally gets the difficulty level value of the operating conditions. The identification of the difficulty level of the operating condition is beneficial to control the power output mode of the diesel engine and realize the distribution according to demand; simultaneously, as the judgment basis of intelligent shift control strategy, it has great significance for intelligent shift, power mode control and improvement of operation performance of engineering vehicles. It is also beneficial to the improvement of the performance and the energy saving and emission reduction; at the same time, the identification of the difficulty level of the operating condition is used to realize the change of power regulation, improve the application scope of engineering machinery. One machine can be used for a variety of different operating conditions, which can achieve the machine multipurpose and improve the operation performance and intelligence level.

DETAILED DESCRIPTION OF THE EMBODIMENTS

The present invention is further described below with reference to the drawings and the preferred embodiments.

Figure 1:
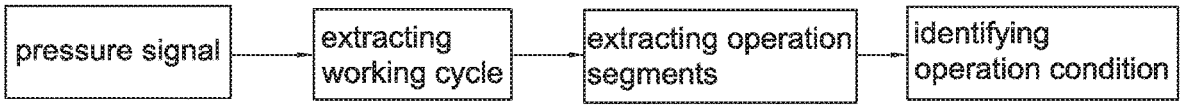
FIG. 1 is a basic framework of the identification method of the present invention.

The main steps of the method described in the present invention, as shown in FIG. 1, are as follows:

1) obtaining the signal of the pressure of the large chamber of the moving arm and the pressure of the large chamber of the rotating bucket from the loader;

2) cleaning and calculating the signal of the pressure of the large chamber of the moving arm and the pressure of the large chamber of the rotating bucket, and extracting the working cycle;

3) extracting the excavating operation segments based on the obtained working cycle;

4) obtaining the excavate time of the pressure of the large chamber of the moving arm, the change rate of the excavate time, the maximum value of the pressure of the large chamber of the moving arm and the change rate of maximum value of the pressure of the large chamber of the moving arm in the excavating operation segments, then the difficulty level index of the operating condition is obtained according to the presupposed rules.

Figure 4:
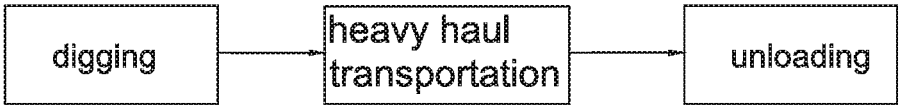
FIG. 4 is a schematic diagram of the work cycle of the identification method of the present invention.

The working cycle, mainly meaning each working cycle segment of the loader excavation process, comprises: an excavating operation segment, a heavy haul transportation work section and an unloading work section (as shown in FIG. 4). Defining that the excavating segments are continuous, namely, the starting point of the excavating operation section is A1; the end point of the excavation section is the starting point of the heavy haul transportation work section which is labeled A2; the end point of the heavy haul transportation work section is the starting point of the unloading work section which is labeled A3; the end point of the heavy unloading work section is A4.

The excavating operation section is defined as follows: the starting point of the excavating operation section is when the bucket is in contact with the material, the pressure of the large chamber of the moving arm begins to increase drastically, and the minimum value point is obtained before the change, which is due to the bucket placed on the ground before excavating. At this time the value of the pressure of the large chamber of the moving arm is smaller than that of normal driving. Therefore, the minimum value point of the pressure of the large chamber of the moving arm before the change is defined as the starting point of the excavation section; the end time of the excavation section is when the bucket is filled with the material and divorced from the working face, at this point generally with the received-bucket action (usually 1-2 times), the pressure of the large chamber of the rotating bucket will appear a maximum value when each received-bucket action, after the completion of the received-bucket action, the pressure of the rotating bucket large chamber will decrease steadily, the first maximum value point of the pressure of the large chamber of the rotating bucket is defined as the end time of the excavating operation section.

The present invention analyzes the excavation operation section and draws the following characteristics:

(1) Due to the different state and different density of different materials, the time of single excavation operation is different, and the change rate of each excavation time is different. For example, fine sand and iron ore are contrasted when they are in the state of discrete particles. Due to the high density and large size of the iron ore and the difficulty of excavation, the time of single excavation operation is much higher, and the change rate of the excavate time is relatively large.

(2) Different materials have different density, which resulted in different value of the moving arm large chamber when it is full bucket in a single excavation operation. Compare fine sand with iron ore, the density of iron ore is obviously much better than that of fine sand, therefore, the maximum value of the pressure of the large chamber of the moving arm when full bucket is certainly larger.

(3) Different materials, due to a more difficult excavation, often appear unable to shovel full bucket situation. Because of the high density of iron ore and native soil, the probability of completing the full bucket is very small, especially the iron ore, half bucket is quite a bucket of the fine sand with the weight.

Figure 2:
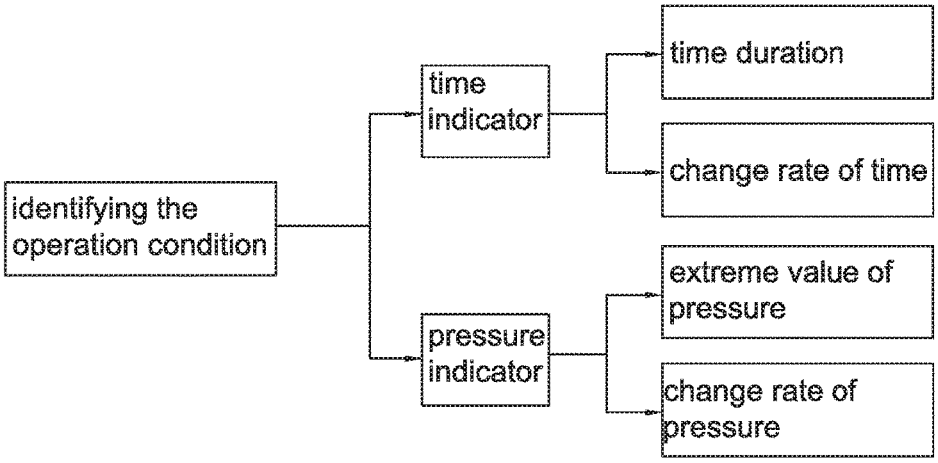
FIG. 2 is a schematic diagram of the evaluation of the operating conditions of the present invention.

(4) Different drivers have different operation habits and different operation experience, which lead to different degree of shovel and different speed of excavation during the test process. It will also affect the length of the excavation time and the change rate of the excavation time in the excavation operation section. Based on the above characteristics, the present invention proposes an operating condition evaluation index, as shown in FIG. 2. Work difficulty is used to measure the complexity of operating conditions, and use the percentage value 0-100% to rate the level. The evaluation of operating condition is mainly composed of time index and pressure index. Wherein the time index includes the length of time and the change rate of the time, and the pressure index includes the extreme value of the pressure and the change rate of the pressure. The main object of the time index and the pressure index is the signal of the pressure of the large chamber of the moving arm in the excavation operation section. It is specifically expressed as the length of the time of the excavating operation segment and the change rate of the excavation operation time; the maximum value of the pressure of the large chamber of the moving arm in excavating operation segment and the change rate of the pressure to reach the maximum value process.

Figure 3:
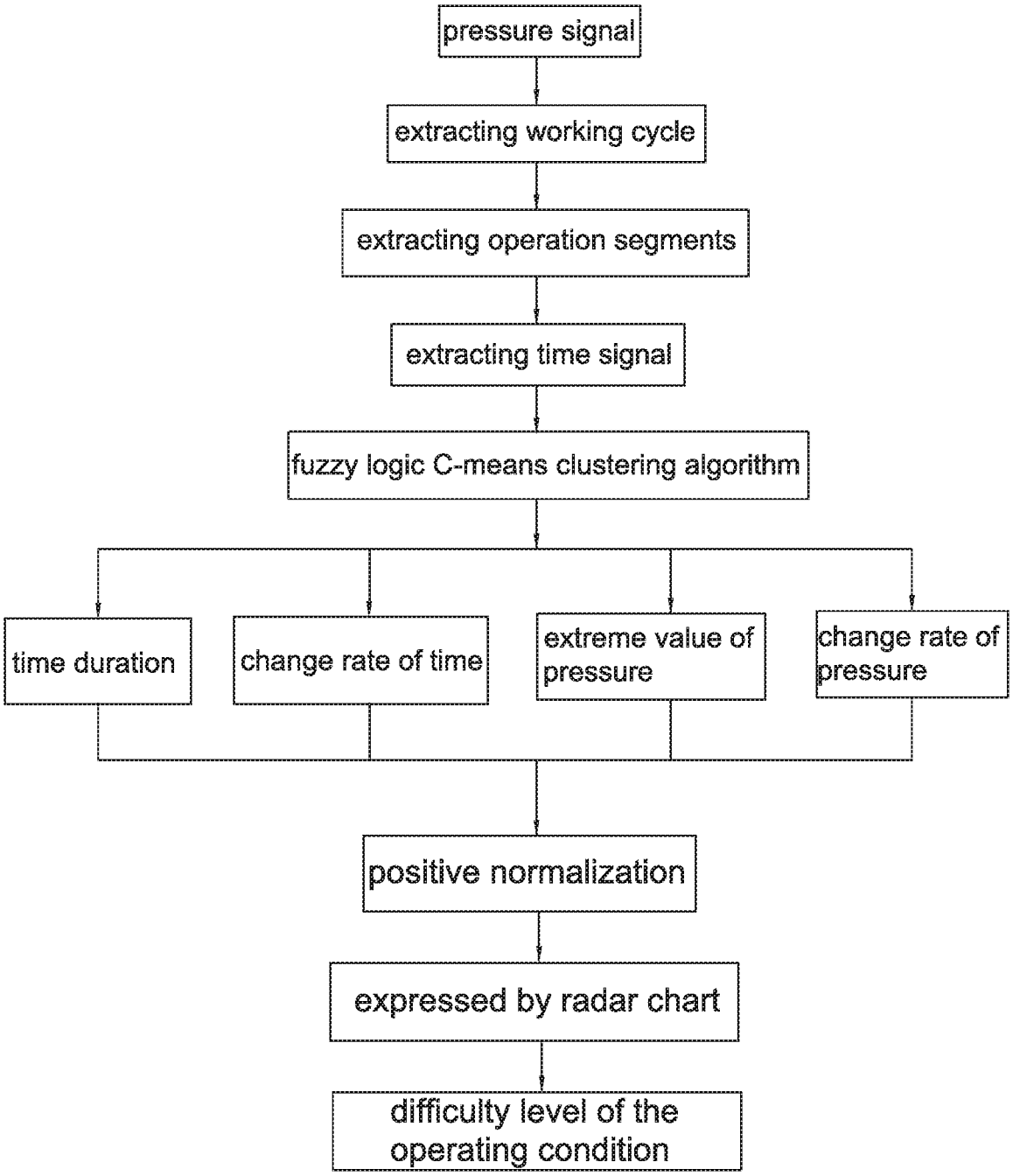
FIG. 3 is a flowchart of the identification method of the present invention.

As shown in FIG. 3, the method described in the present invention, firstly, the working cycle of the pressure signal is extracted. After the working cycle is obtained, the operation segment is further extracted and the signal of the excavating operation segment is obtained. Then analyze and identify as follows:

The fuzzy logic C-means clustering algorithm is used to cluster analysis of the excavate time, the change rate of the excavate time, the maximum value of the pressure of the large chamber of the moving arm and the change rate of maximum value of the pressure of the large chamber of the moving arm.

Assuming that the sequence of the excavate time length is $T=(t_1, t_2, \ldots, t_i, \ldots, t_{n-1}, t_n)$.

According to the fuzzy logic C-means clustering algorithm, the length of the excavate time $t_{FCM}$ and the change rate of the excavate time $u_t$ in each section are obtained:

$$u_t = \frac{|t_i - t_{FCM}|}{t_{FCM}},$$

wherein, i=1, 2, . . . n

Calculation of cluster center value $u_{FCM}$ according to the change rate of the excavate time $u_t$, and $u_{FCM}$ will be used as the evaluation value of the change rate of the excavate time.

For the convenience of analysis, assuming that there is only one excavating operation in a excavating time, that is done with one shovel, and make all curves of the pressure of the large chamber of the moving arm in the excavating operation segments are second-order parabolic fitted, the fitting function is: $p=a+bt+ct^2$;

According to the fitting function, the maximum value $p_{max}$ of the pressure of the large chamber of the moving arm and the time t to reach the maximum value are obtained. The formula of maximum value change rate of the pressure of the large chamber of the moving arm is as follows:

$$u_p = \frac{|p_i - p_{max}|}{p_{max}},$$

wherein, i=1, 2, . . . n;

Wherein, $u_p$ is maximum value change rate of the pressure of the large chamber of the moving arm, $p_i$ is one pressure value of the pressure of the large chamber of the moving arm, $p_{max}$ is the maximum value of the pressure of the large chamber of the moving arm.

According to the analysis of the excavate time, the change rate of the excavate time, the maximum value of the pressure of the large chamber of the moving arm and the change rate of maximum value of the pressure of the large chamber of the moving arm, it is found that the three parameters, the excavate time, the change rate of the excavate time, the maximum value of the pressure of the large chamber of the moving arm, are proportional to difficulty level of the operating condition, while the change rate of maximum value of the pressure of the large chamber of the moving arm is inversely proportional. In order to unify the relationship, the excavate time, the change rate of the excavate time, the maximum value of the pressure of the large chamber of the moving arm and the change rate of maximum value of the pressure of the large chamber of the moving arm is mapped to the radar chart of the unit circle, and the values are treated with positive normalization.

In this embodiment, assuming that the maximum length of time is 20 s, the normalized value is 1 when the length of time is greater than or equal to this value; otherwise the time length shall be divided by the maximum value to get the normalized value; the change rate of the excavate time, which is in line with the normalized value, is left untreated; divide the maximum pressure value by the largest pressure value to get the normalized value, for the maximum pressure of the moving arm large chamber is 20 Mpa; first divide the change rate of pressure by the maximum pressure value, then get the countdown, and the normalized value shall be 1 if the countdown is greater than the maximum, which is assumed as 3; otherwise the countdown shall be divided by 3 to get the normalized value. After unification, all the standard eigenvalues have the same influence on the evaluation of the difficulty of operation.

The positive normalization value is obtained and expressed by radar chart. For further calculating the work difficulty value, the index of the difficulty level of the operating condition is obtained by calculating the cover area of each operating condition in the radar chart and defining the ratio of each radar chart to the unit circle area as the work difficulty value.

Figure 5:
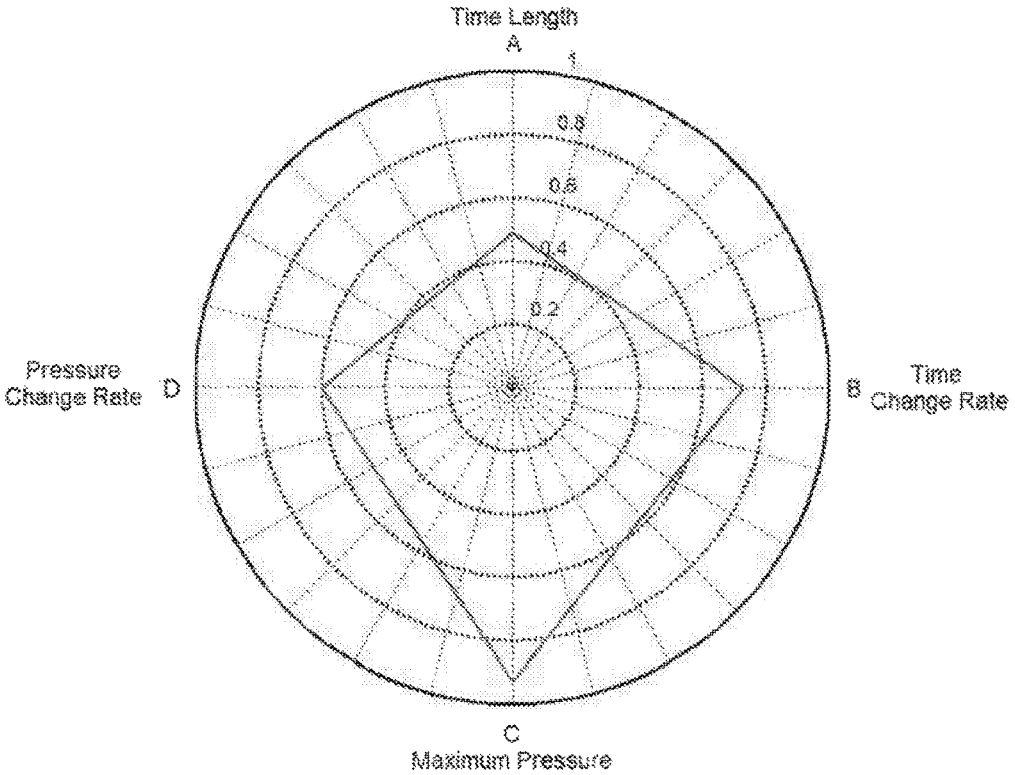
FIG. 5 is a radar chart showing the ease of operating conditions of the present invention.

FIG. 5 shows the method of radar graph representation described in the present invention, A in the drawing represents the length of time, B represents the change rate of the time, C represents the maximum value of the pressure, D represents the change rate of the pressure. The eigenvalues of the four difficulty levels of the operating condition are obtained according to the above method, which are marked on the drawing by the unit circle radar chart as shown in FIG. 5. The four eigenvalues form a quadrilateral ABCD, whose area is assumed to be $S_F$, and the area of the unit circle is $S_{UC}$. Then the difficulty level of the operating condition K can be expressed as:

$$K = \frac{S_F}{S_{UC}}$$

Figure 6:
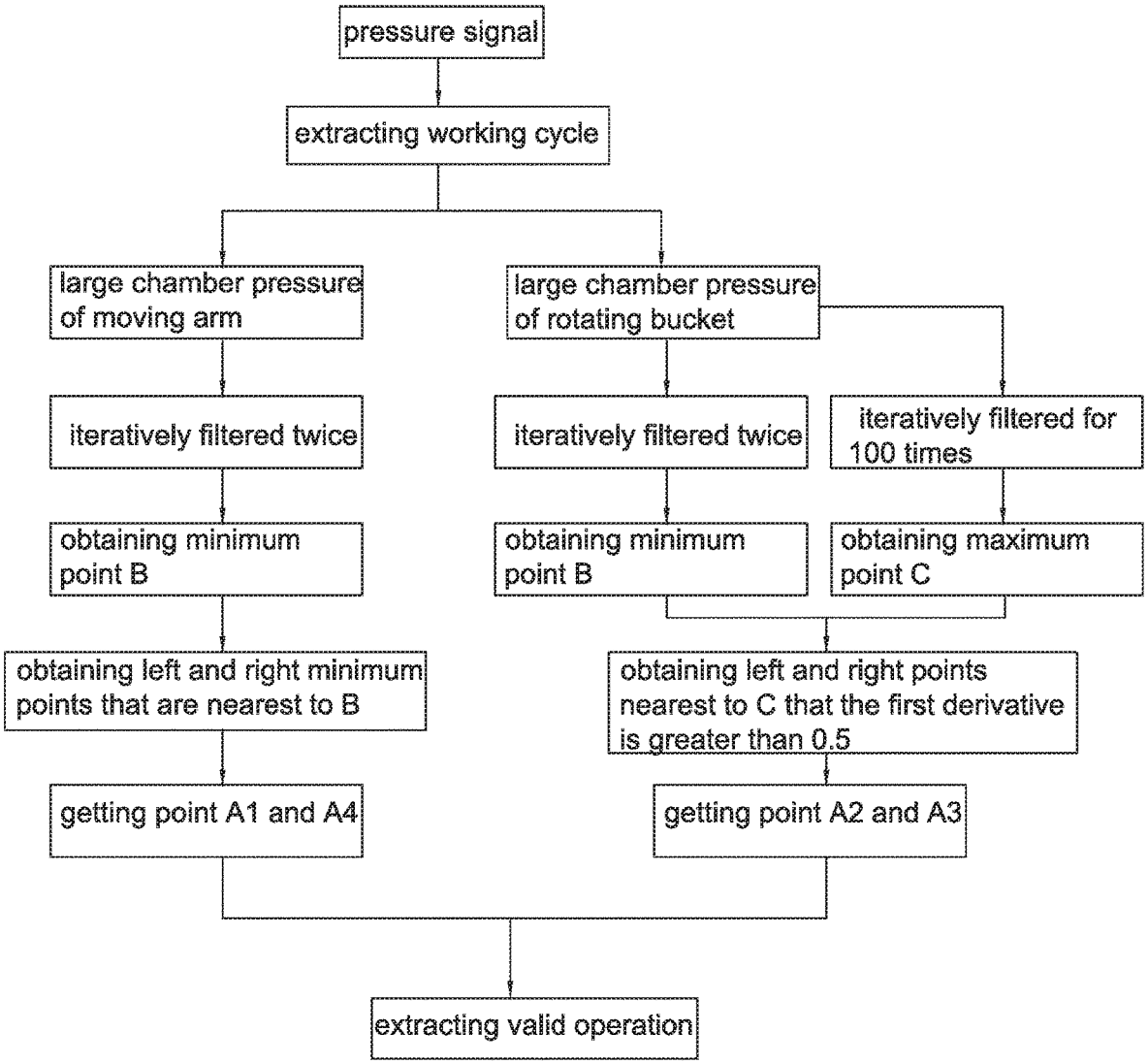
FIG. 6 is a flowchart of a work cycle extraction process of the identification method of the present invention.

As shown in FIG. 6, the work cycle extraction of the identification method of the present invention comprises the following steps:

(1) Acquisition of the pressure signal: obtaining the signal of the pressure of the large chamber of the moving arm and the pressure of the large chamber of the rotating bucket from the loader.

(2) Extracting work cycle: cleaning, calculating the signal of the pressure of the large chamber of the moving arm to obtain the minimum value point B. The starting point A1 and the ending point A4 of the working section are obtained according to the calculation of the minimum point B.

The specific steps comprise:

2.1 The signal of the pressure of the large chamber of the moving arm is iteratively filtered twice.

2.2 Find the minimum point B.

2.3 Find the left and the right minimum points that are nearest to B.

2.4 Get the points A1, A4.

Cleaning, calculating the signal of the pressure of the large chamber of the rotating bucket to obtain the maximum value point C. Based on the maximum point C, the nodes A2 and A3 of the working section are obtained.

2.5 The signal of the pressure of the large chamber of the rotating bucket is iteratively filtered twice, and then take the first derivative of it.

2.6 The signal of the pressure of the large chamber of the rotating bucket is iteratively filtered one hundred times, and then fine the maximum value point C.

2.7 Find the point nearest to C of which the first derivative is greater than 0.5.

2.8 Get the points A2, A3.

(3) Extract valid operation: according to the above calculation to obtain A1, A2, A3, A4 and effective operation information. Among them, the excavating operation segment is between A1 and A2.

The above embodiments are only for illustrating the present invention, and are not intended to limit the present invention. The variations, modifications and the like of the above embodiments, according to the technical essence of the present invention, will fall within the scope of the claims of the present invention.

INDUSTRIAL APPLICABILITY

The present invention provides a method of identifying the difficulty level of the operating conditions of a loader, which takes the excavating operation segments extracted by the operation segment as the main objects of study to identify the operating conditions, and finally get the difficulty level value of the operating condition. The identification of the difficulty level of the operating condition is used to realize the change of power regulation, improve the application scope of engineering machinery. One machine can be used in a variety of different operating conditions, which can achieve the machine multipurpose and improve the operation performance and intelligence level.

The invention claimed is:

1. A method of identifying a difficulty level of an operating condition of a loader, wherein the method comprises:

1) obtaining a first signal of a pressure of a chamber of a moving arm and a second signal of a pressure of a chamber of a rotating bucket from the loader, cleaning the first signal and the second signal and using the first signal and the second signal to obtain at least one working cycle;

2) extracting at least one excavating operation segment based on the at least one working cycle; and 3) obtaining, according to predefined rules, an excavate time, a change rate of the excavate time, a maximum value of the pressure of the chamber of the moving arm, and a change rate of the maximum value of the pressure of the chamber of the moving arm in each of the at least one excavating operation segment to obtain the difficulty level of the operating condition.

2. The method of identifying the difficulty level of the operating condition of the loader according to claim 1, wherein;

a minimum point of the pressure of the chamber of the moving arm formed before the loader contacts material is defined as a starting time of each of the at least one excavating operation segment, and a first maximum value point of the pressure of the chamber of the rotating bucket is defined as an end time of each of the at least one excavating operation segment.

3. The method of identifying the difficulty level of the operating condition of the loader according to claim 1, wherein, in the step 3), a fuzzy logic C-means clustering algorithm is configured to cluster analysis of the excavate time, the change rate of the excavate time, the maximum value of the pressure of the chamber of the moving arm and the change rate of the maximum value of the pressure of the chamber of the moving arm in each of the at least one excavating operation segment to obtain a characteristic excavate time $t_{FCM}$.

4. The method of identifying the difficulty level of the operating condition of the loader according to claim 3, comprising:

in each of the at least one excavating operation segment, assuming that a sequence of the excavate time is $T=(t_1, t_2, \ldots, t_i, \ldots, t_{n-1}, t_n)$:

calculating a characteristic change rate of the excavate time $u_t$ in the excavating operation segment according to a formula:

$$u_t = \frac{|t_i - t_{FCM}|}{t_{FCM}},$$

wherein i=1, 2, . . . , n; and calculating a cluster center value $u_{FCM}$ according to the characteristic change rate of the excavate time $u_t$, wherein the cluster center value and $u_{FCM}$ is used as an evaluation value of the characteristic change rate of the excavate time.

5. The method of identifying the difficulty level of the operating condition of the loader according to claim 4, comprising:

assuming that there is only one excavating operation segment in the excavate time of each of the at least one excavating operation segment, making all curves of the pressure of the chamber of the moving arm in the at least one excavating operation segment fit to a second-order parabolic curve according to a fitting function $p=a+bt+ct^2$;

according to the fitting function, calculating a characteristic maximum value $p_{max}$ of the pressure of the chamber of the moving arm and a time t to reach the characteristic maximum value $p_{max}$ of the pressure of the chamber of the moving arm; and calculating a characteristic change rate $u_p$ of the characteristic maximum value $p_{max}$ of the pressure of the chamber of the moving arm according to a formula:

$$u_p = \frac{|p_i - p_{max}|}{p_{max}},$$

wherein i=1, 2, . . . , n, and $p_i$ is one value of the pressure of the chamber of the moving arm of each of the at least one excavating operation segment.

6. The method of identifying the difficulty level of the operating condition of the loader according to claim 5, wherein:

the characteristic excavate time, the characteristic change rate of the excavate time, the characteristic maximum value of the pressure of the chamber of the moving arm and the characteristic change rate of the characteristic maximum value of the pressure of the chamber of the moving arm are respectively mapped to a radar chart of a unit circle to obtain a positive normalization value of the at least one excavating operation segment.

7. The method of identifying the difficulty level of the operating condition of the loader according to claim 6, comprising:

after obtaining the positive normalization value, expressing the positive normalization value by the radar chart;

calculating a cover area in the radar chart; and defining an ratio of the radar chart to an area of the unit circle as the difficulty level value.

8. The method of identifying the difficulty level of the operating condition of the loader according to claim 1, wherein each of the at least one working cycle comprises one of the at least one excavating operation segment, a heavy haul transportation work section and an unloading work section.

9. The method of identifying the difficulty level of the operating condition of the loader according to claim 1, wherein using the first signal and the second signal to obtain the working cycle comprises:

obtaining a minimum value point B from the first signal;

calculating a starting point A1 and an ending point A4 of each of the at least one working cycle according to the minimum value point B;

obtaining a maximum value point C from the second signal; and calculating a first node A2 and a second node A3 of each of the at least one working cycle based on the maximum value point C, wherein the at least one excavating operation segment is between the starting point A1 and the first node A2.

10. The method of identifying the difficulty level of the operating conditions of the loader according to claim 8, wherein using the first signal and the second signal to obtain the working cycle comprises:

obtaining a minimum value point B from the first signal;

calculating a starting point A1 and an ending point A4 of each of the at least one working cycle according to the minimum value point B;

obtaining a maximum value point C from the second signal; and calculating out a first node A2 and a second node A3 of each of the at least one working cycle based on the maximum value point C, wherein the at least one excavating operation segment is between the starting point A1 and the first node A2.

* * * * *